US006010004A

United States Patent [19]

Huckriede et al.

[11] Patent Number: 6,010,004

[45] Date of Patent: Jan. 4, 2000

[54] PACKING MEANS FOR POURABLE MATERIAL

[75] Inventors: Klaus Huckriede; Uwe Erber, both of Lengerich, Germany

[73] Assignee: Bischof und Klein GmbH & Co., Lengerich, Germany

[21] Appl. No.: 09/145,350

[22] Filed: Sep. 1, 1998

[30] Foreign Application Priority Data

Sep. 5, 1997 [DE] Germany ..... 297 15 972 U

[51] Int. Cl.[7] ..... B65D 23/10

[52] U.S. Cl. ..... 206/525; 220/761; 220/767; 206/804; 206/806

[58] Field of Search ..... 206/804, 806, 206/525; 220/752, 754, 756, 757, 761, 762, 763, 767, 770, 776

[56] References Cited

U.S. PATENT DOCUMENTS 2,005,528 6/1935 Berchulc ..... 220/761 X 5,111,952 5/1992 Stocchiero ..... 220/761 X

*Primary Examiner*—Jacob K. Ackun

*Attorney, Agent, or Firm*—Jordand and Hamburg LLP

[57] ABSTRACT

A packing for pourable materials constructed from paper, from plastic sheet or from a similar flexible material has the form of a package or bag which is closed at both ends. A pouring opening for removing contents from the package is to be produced by the consumer in a transition region between one of the two closed ends of the package and the adjoining narrow side wall of the package. In a region of the other of the two closed ends of the package essentially diagonally opposite to the pouring opening that is to be produced, a holding device of an, in turn, flexible material is provided, which normally extends within the outer contour of the package. However, the holding device can be pulled with a part, forming an external gripping handle, out of the package for the purpose of removing material from the package and serves as a pouring aid.

25 Claims, 4 Drawing Sheets

PACKING MEANS FOR POURABLE MATERIAL

BACKGROUND OF THE INVENTION

The invention relates to packing means for pourable materials, constructed from paper, plastic sheet or from a similar flexible material, in the form of a package or bag, which is closed at both ends and in which a pouring opening for removing contents from the package is to be produced by the consumer in a transition region between one of the two closed ends of the package and the adjoining narrow side wall of the package.

In known packing means of this type, especially the pouring out of partial amounts of the contents is facilitated by the pouring opening. For this purpose, it is necessary, for carrying out a pouring process, to lift and tilt the filled packing means, so that the contents can run out of the pouring opening, which is usually provided in the region of the upper comer of the packing means. Because of the weight of the material filled into the packing means, especially when these packing means are in the form of a package, this creates difficulties, which hinder particularly the accurate pouring out of smaller partial amounts of material.

SUMMARY OF THE INVENTION

It is an object of the invention to provide packing means for pourable materials of the initially described type, the handling of which, particularly for the removal of flowable or pourable materials in portions, is facilitated.

Pursuant to the invention, this objective is accomplished owing to the fact that in a region of the other of the two closed ends of the package essentially diagonally opposite to the pouring opening that is to be produced, a holding device of an, in turn, flexible material is provided, which normally extends within the outer contour of the package and can be pulled with a part, forming an external handle, out of the package for the purpose of removing material from the package.

For carrying out a pouring process, the inventive packing means, filled with a material, is brought into a position, in which the holding device is in or close to an upper corner of the package and, accordingly, the pouring opening, which can be formed, for example, by the consumer by cutting off a corner of the package, is in the lower corner of the package essentially diagonally opposite to the holding device. The holding device, which is within the outer contour of the package during transport and storage, is then pulled out from the package with a part for removing material from the package. This part forms a gripping handle, which can conveniently be gripped by a hand of the consumer as a pouring aid in order to raise the filled packing means more or less and to carry out the pouring process through the previously formed pouring opening, optionally by supporting the packing means with the other hand below the pouring opening. The handling is facilitated significantly in this manner and, in particular, the removal of portions of material from the package can be carried out comparatively effortlessly.

The two closed ends of the package of the inventive packing means can, in other respects, have the shape of a cross bottom, block bottom or form bottom with corner tucks and bottom folds. The form bottom, which has the holding device, provided for pursuant to the invention, in the region of one half of the bottom, seen in the longitudinal direction of the bottom, can be provided at the end of the other half with a filling valve for filling the package. Such filling valves, which at the end of the filling process may bring about a sealing of the valve opening automatically under the weight of the material filled into the package, are known in numerous embodiments in the technology of manufacturing and filling packages.

The seal of the package or the form bottom, lying opposite to the bottom of the package with the holding device and optionally opposite to the filling device, can moreover be provided with a carrying handle for transporting the filled package by hand. In this case, the inventive packing means are provided with two handles, one of which, as is generally known for packages that can be carried, can be taken hold of from the outside by the user by hand, while the handle in the other, opposite bottom of the package or form bottom initially lies within the outer contour of the package and thus cannot readily be grasped by hand and, instead, is activated by the consumer by being pulled out of the package in order to serve as a gripping handle only when material is to be removed from the package, perhaps by way of a slot, after a perforation or similar line of weakness in the material is severed.

The invention is explained in greater detail in the following by means of the drawing, in which two examples of the object of the invention are illustrated diagrammatically.

IN THE DRAWINGS

FIG. 1 shows a perspective representation of a first example of filled inventive packing means, the holding device, when in the position of non-use, being within the packing means, FIG. 2 shows a longitudinal section through the upper corner region of the packing means of FIG. 1, containing the holding device, FIGS. 3 and 4 show representations corresponding to FIGS. 1 and 2, in which, however, the holding device is pulled out of the interior of the packing means with the help of an external part forming a gripping handle, FIG. 5 shows a perspective representation of a further example of filled inventive packing means with the holding device in the non-use position, FIG. 6 shows a longitudinal section through the closed end of the package of FIG. 5, containing the holding device, and FIG. 7 shows a representation corresponding to that of FIG. 5, in which, however, the holding device is pulled out of the packing means with a part forming an external handle.

DESCRIPTION OF THE PREFERRED EMBODIMENTS

Figure 2:
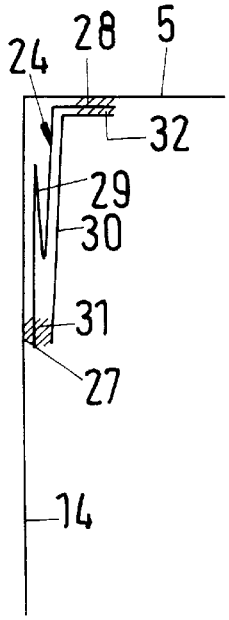

For the examples selected, the packing means, shown in the drawings, have the shape of a cross bottom, block bottom or similar form bottom package, which has a basic parallelepipedic configuration in the filled state. The two ends 1 and 2 of the package are closed off by a form bottom. The form bottom of the end 1 of the package comprises bottoms folds 3, 4 and comer tucks 5, 6, which in each case lie opposite one another in pairs, and an external bottom covering sheet 7. Correspondingly, the form bottom of the package end 2 comprises bottom folds 8, 9 and corner tucks 10, I1, which in turn in each case lie opposite one another in pairs, and an external bottom covering sheet 12, which has a carrying loop 13, which can easily be taken hold of from outside and is used as carrying handle for transporting the filled packing container by hand, the packing container being in a position, in which the package end 2 is at the top. At their two ends, the form bottoms of the package ends 1, 2 in each case change over into the narrow side walls 14 and 15 of the package, which in turn lie between the mutually facing wide side walls 16, which form the front and rear walls of the package. A filling valve 17, the details of which are not shown, is provided at one end of the form bottom of the package end 1 for filling the packing means or package.

In the case of the example of FIGS. 1 to 4, the form bottom of the package end 2 is provided at one end with an outlet part 18 for the material in the package. The outlet part 18 is formed by a flap of material of the narrow side wall 15, which can be folded out of the narrow side wall 15 along a fold line 19 adjoining the end 2 of the package for forming a pouring opening. For folding out the outlet part or material flap 18, a perforation line or a similar line of weakness 20 is severed in the narrow side wall 15. Behind the flap of material 18, a material blank 21 is fastened to the inside of the packing means, for example, by means of a peripheral glue bond 22. The material blank 21 is also severed over a perforation line or a similar line of weakness, the details of which are not shown and optionally pulled partially out of the opening forming in the narrow side wall 15. It contributes towards forming the pouring opening in the form of a pouring spout.

In the comer transition region between the end 1 of the package and the narrow side wall 14 lying diagonally opposite to the outlet part 18, that is, at the end of the form bottom of the end 1 of the package lying opposite to the filling valve 17, a holding device 23 is fastened to the inside of the package. The holding device 23, like the packing material itself, consists of paper, plastic sheet or a similar flexible material and is formed from a longitudinal flexible strip 24, which is limited in length to the comer transition region and at the transverse edges 25 and 26 of which, within the package, fastening sites 27 and 28 are formed, for example, by hot melt bonds or adhesive bonds between the longitudinal strip 24 and the inside of the narrow side wall 14 or the inside of the comer tucks 5 of the end 1 of the package. Between the two fastening sites 27, 28, the length of the longitudinal strip 24 is overdimensioned in the form of a material storage fold 29.

On the inside, the longitudinal strip 24 is overlapped by a covering sheet 30, which is fastened to the inside of the package and serves, at the same time, as carrying sheet for the longitudinal strip 24 in that the underside of the latter is fastened by a glue bond or a similar bond 31, 32 to the upper side of the covering sheet 30. The longitudinal strip 24 and the covering sheet 30 accordingly can be handled as a unit during the manufacture of the packing means and fastened to the inside of the latter. This fastening to the inside of the package is accomplished by means of the glue bonds 27 and 28, which extend without interruption on either side of the transverse edges 25, 26 of the longitudinal strip 24 on the covering sheet 30 and by means of the glue bonds 33, 34, extending perpendicularly to the glue bonds 27 and 28 and bonding the covering sheet 30 to the inside of the package.

Figure 1:
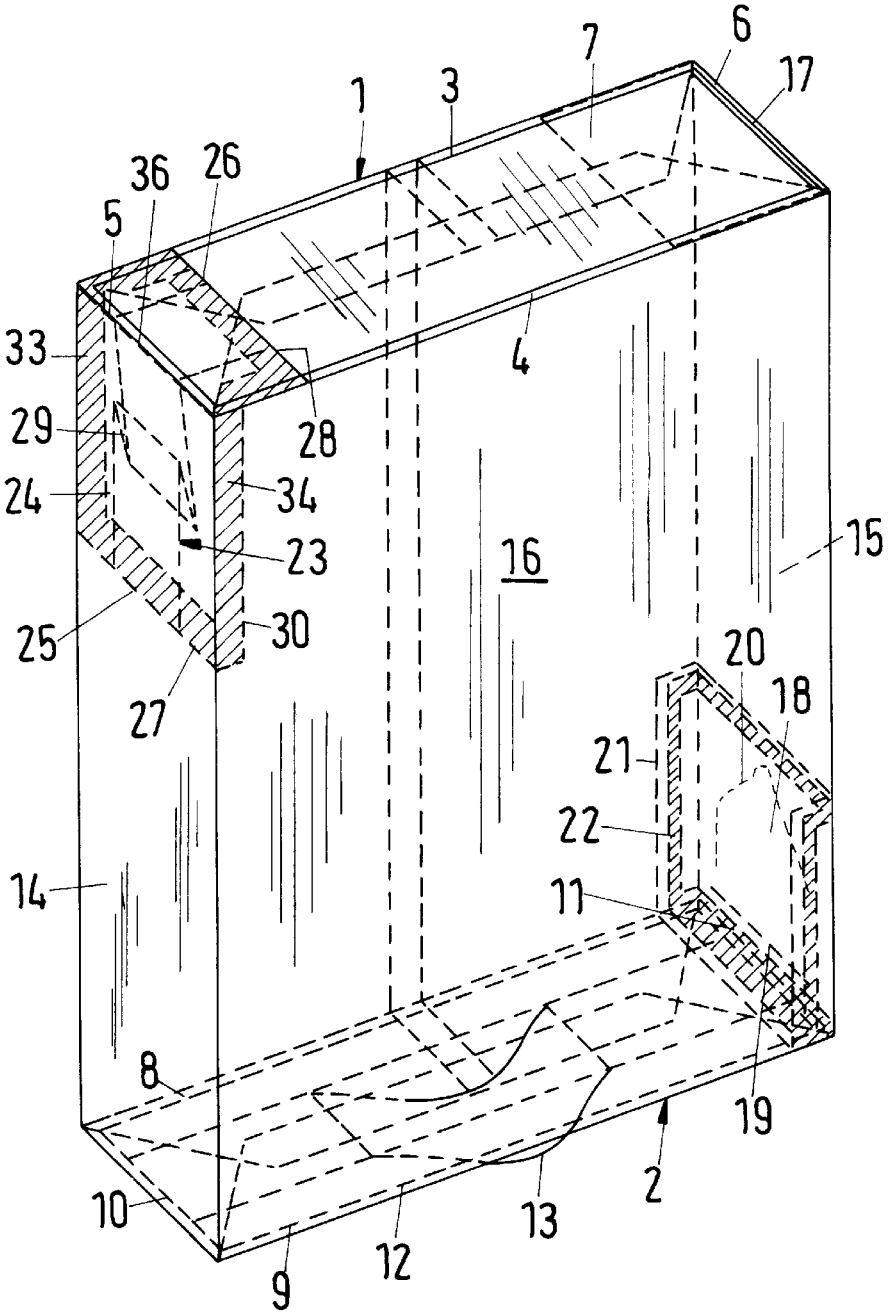
Figure 4:
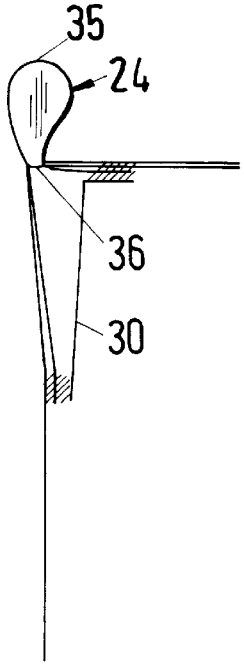
Figure 3:
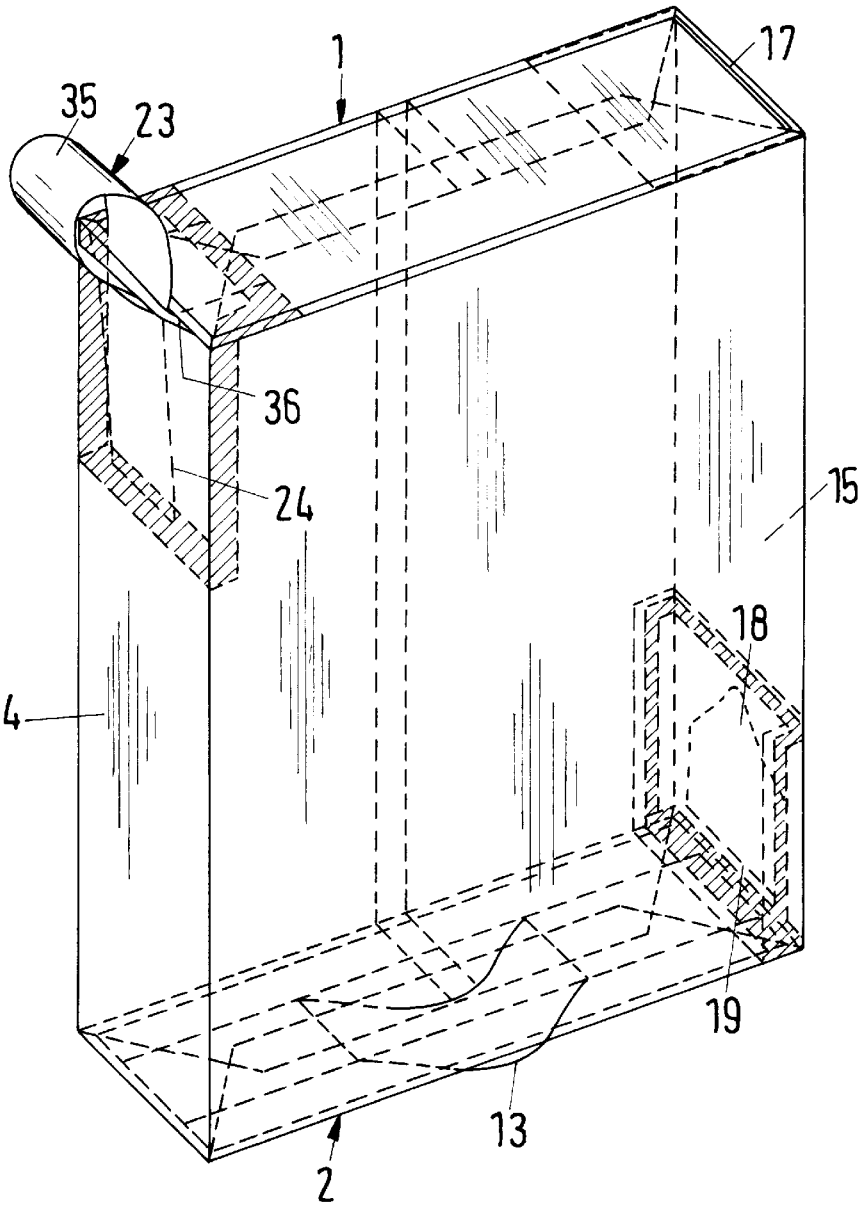

As is shown particularly by FIGS. 1 and 3, the width of the covering sheet 30 exceeds that of the longitudinal strip 24 and slightly also that of the narrow side wall 14. The covering sheet 30 thus is fixed continuously to the inside of the package by the peripheral bonds 25, 26, 33, 34 and, in this manner, together with the region of the inside of the package facing it, forms an accommodating pocket for the longitudinal strip 24, which is closed off all around. By these means, the holding device 23, with its longitudinal strip 24, is shielded from the filling space of the packing means. The longitudinal strip 24, with its material storage fold 29, thus can neither be contaminated nor blocked by the material filling the packing means, when the longitudinal strip 24, which normally extends within the packing means close to the inside of the package, is pulled out with a part from the interior of the package in connection with removing contents from the package, in order to form a gripping handle 35 in the form of a loop of material (FIGS. 3 and 4).

So that the part of the longitudinal strip 24, forming the gripping handle 35, can be pulled out of the interior of the package, a removal slot 36, extending transversely to the longitudinal direction of the longitudinal strip 24, is provided in the transition region between the end 1 of the package and the narrow side wall 14, that is, at the end of the form bottom of the package end 1. The removal slot 36 is formed by severing a perforation line or a similar line of material weakness in the package material. The part of the longitudinal strip 24, forming the loop-shaped gripping handle 35, can then be pulled effortlessly out of the interior of the package, since this part or, in the case of the example shown, the longitudinal strip as a whole has a width, which is less than the length of the removal slot 36. The material storage fold 29 is unfolded effortlessly while being pulled out and then forms the loop-shaped gripping handle 35.

By lifting up the packing means at the holding loop 35 by hand and tilting in the direction of the outlet part 18, lying diagonally opposite at the other end 2 of the package, the material in the package can be poured out, particularly in portions, after the outlet part 18 has been opened to form the pouring opening. It is self-evident that, after a portion of the contents of the package has been removed, the outlet part 18 can be folded back once again and closed and, if desired, the part of the longitudinal strip 24, forming the gripping handle 35, can be inserted through the slot 36 once again into the accommodating pocket of the holding device on the inside of the package. The loosely inserted part can then be pulled out once again at any time without difficulties when further material is to be removed.

Figure 5:
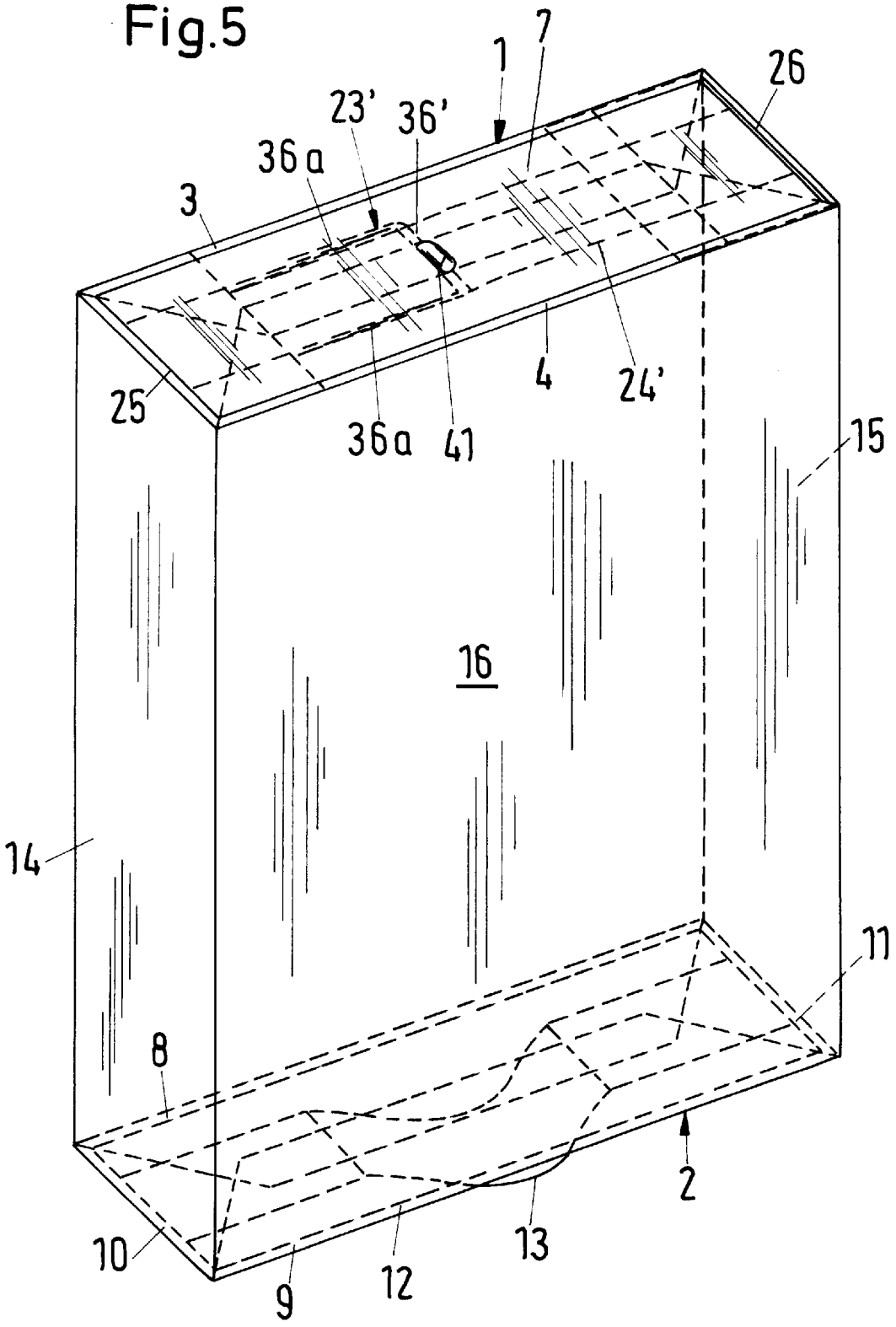
Figure 7:
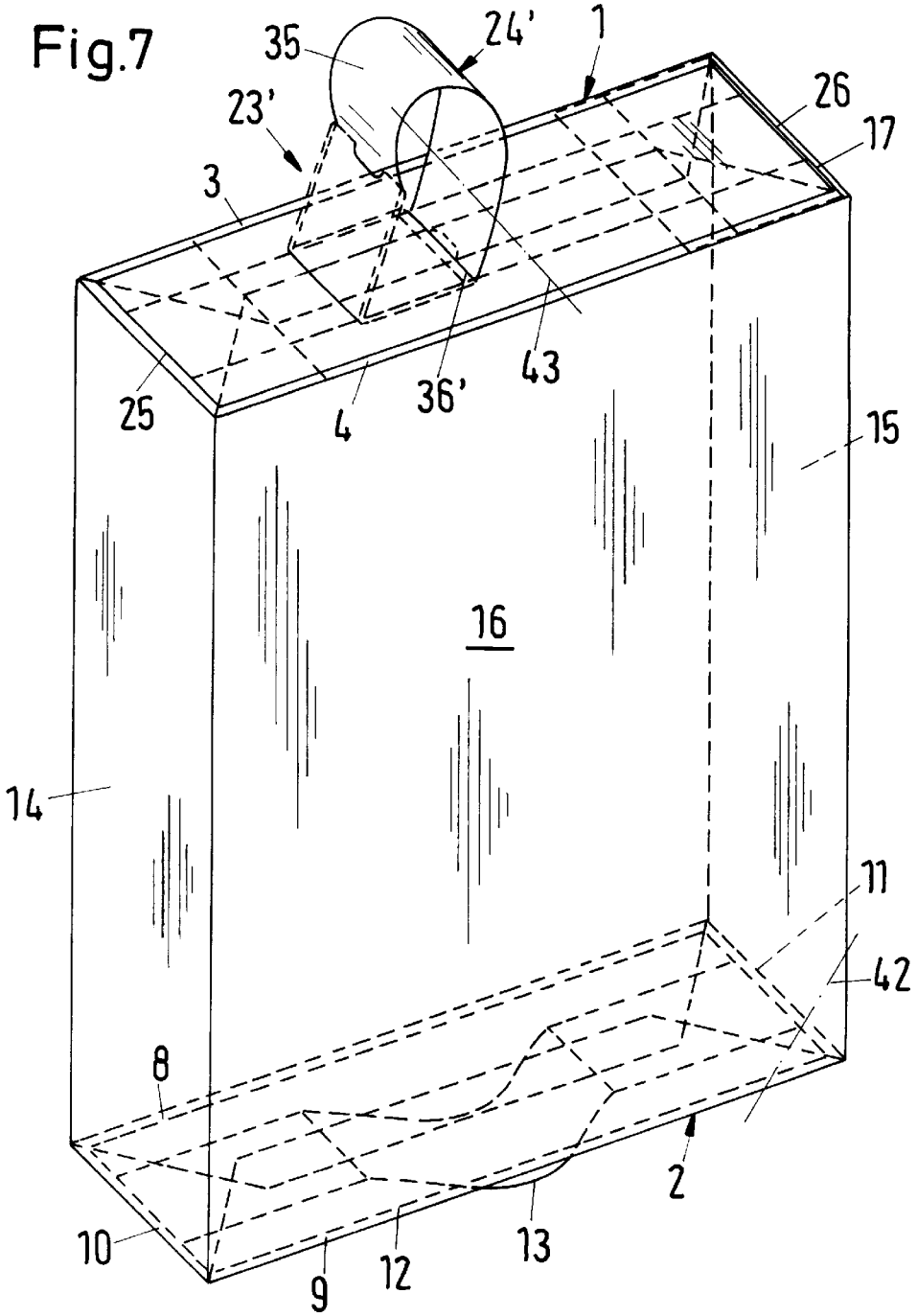
Figure 6:
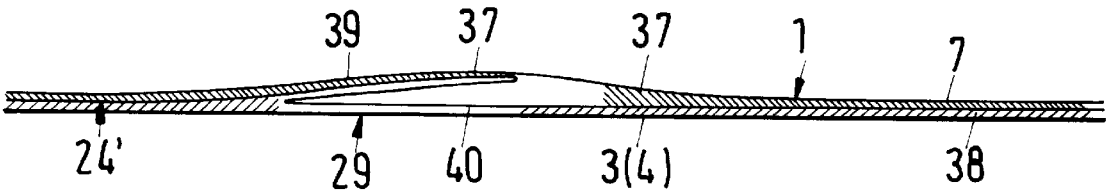

For the example of FIGS. 5 to 7, the reference numbers are the same as those used for identical or functionally similar parts of the first example without a further description. The basic structure of the packing means of FIGS. 5 to 7, with the ends 1 and 2 of the package closed by a form bottom and comprising the respective bottom side folds 3, 4 or 8, 9 and corner tucks 5, 6 or 10, 11 and an external sheet 7 or 12 with the carrying loop 13 externally covering the bottom, is the same as that of the example of FIGS. 1 to 4.

A modification with respect to the first example has been made with regard to the holding device 23', which is incorporated in the present example in the form bottom of the closed end 1 of the package and overlapped by the external covering sheet 7 fastened to the outside of the form bottom of the closed end 1 of the package, particularly by gluing, and connected with this covering sheet, particularly by gluing. In the non-use position shown in FIG. 5, with the inserted material storage fold 29 (FIG. 6), the longitudinal strip 24' has the same length here as the bottom covering sheet 7, but is narrower than the latter. The bottom covering sheet 7 and the longitudinal strip 24', as a joined together or glued together unit, are connected or glued to the outside of the inwardly folded bottom side folds 3 and 4 of the form bottom.

In FIG. 6, the gluing of the longitudinal strip 24' to the bottom covering sheet 7 and the bottom side folds 3 and 4 is shown diagrammatically. The adhesive 37, connecting the longitudinal strip 24' to the bottom covering sheet 7 is made visible by cross-hatching and the adhesive 38, connecting the longitudinal strip 24' and, next to it, the underside of the bottom covering sheet 7 with the bottom side folds 3, 4, is made visible by diagonal hatching. As furthermore shown in FIG. 6, the material storage fold 29 is constructed Z shaped. The outer length 39 of the storage fold 29 is connected firmly by adhesive 39 to the covering sheet 7, while its inner length 40, adjoining the bottom side folds 3, 4, is not glued to these because of a recess in the adhesive 38.

In the case of this example, the removal slot 36' comprises a thumb hole 41 that is punched out and, on either side thereof, a U-shaped perforation line 36*a* in the bottom covering sheet 7. When the perforation line 36*a* is severed by the user by taking hold of the thumb hole 41, the part of the holding device 23', that is, the Z-shaped material storage fold 29, which forms the gripping handle 35 and lies in the non-use position within the outer contour of the package, is pulled effortlessly with the outer length 39, adhering to the U-shaped part of the bottom covering sheet 7 severed along the perforation line 36*a*, out of the form bottom of the end 1 of the package into approximately the position seen in FIG. 7. In this position, the gripping handle 35 can be taken hold of by hand in order to carry out the process of pouring the contents of the package through a pouring opening, which was previously formed by the consumer in the lower comer of the package approximately diagonally opposite to the gripping handle 35, for example, by cutting off this comer of the package along the line 42 of dots and dashes in FIG. 7.

Compared to the first example, in which the gripping handle 35, pulled out of the package into the use position, is located directly in the comer region between the narrow side wall 14 and the form bottom of the end 1 of the package, the gripping handle 35 of the second example of FIGS. 5 to 7 is shifted more from this comer of the package toward the center of the bottom. The appropriate position of the gripping handle 35 in its use position depends particularly on the dimensions of the packing means, on the material in the package, as well as on the nature and arrangement of the pouring opening, which is specified by the manufacturer of the packing means or produced by the consumer in the comer region of the end 2 of the package or in the lower end region of the narrow side wall 15. In any case, however, it should lie within the region between the comer of the package, formed by the narrow side wall 14 and the end I of the package, and the transverse center line 43 of the end 1 of the package.

What we claim is:

1. A package including a plurality of walls enclosing a package interior for receiving a packageable product, at least one of said walls having a pocket closed off from said package interior, a handle of flexible material, a connection connecting the handle to said one wall, said handle having a stored position in which the handle is stored in the pocket and a deployed position in which the handle extends externally of the pocket where the handle is adapted to be grasped to facilitate emptying the packageable product from the package, said pocket having an outer part having a line of weakness adapted to be severed to facilitate access to said pocket for effecting removal of said handle from said pocket to thereby change the handle from its stored position to its deployed position.

2. A package according to claim 1 wherein said handle includes a strip of flexible material, said strip being folded over on itself when said handle is in said stored position in said pocket.

3. A package according to claim 1 wherein said handle is a strip of flexible material which is generally flat when in said stored position in said pocket.

4. A package according to claim 1 wherein said handle is a strip of flexible material which has a plurality of sections joined by fold lines, said strip of flexible material being folded along said fold lines to dispose said plurality of sections in a superimposed and folded disposition when said handle is in said stored position in said pocket.

5. A package according to claim 1 wherein said handle includes a strip of material having two end regions, said connection including adhesive adhesively adhering each of said two end regions to at least one wall of the package.

6. A package according to claim 5 wherein said adhesive adhesively adheres one of said end regions to said one wall of said package and adhesively adheres the other of said end regions to another wall of said package.

7. A package according to claim 1 wherein said pocket has a slot in said outer part through which the handle is removable from said pocket to thereby change the handle from its stored position to its deployed position.

8. A package according to claim 1 wherein said pocket is formed by a section of said at least one wall and an inner sheet disposed in superimposed relationship with said wall section, and adhesive adhering said inner sheet to said wall section.

9. A package according to claim 1 wherein said package has a corner where said one wall joins another wall, said handle including a strip, said pocket having an openable part juxtaposed to said comer to enable withdrawal of said strip from said pocket through said openable part.

10. A package including a plurality of walls enclosing a package interior for receiving a packageable product, at least one of said walls having a pocket closed off from said package interior, a handle of flexible material, said handle including a strip, a connection connecting the handle to said one wall, said handle having a stored position in which the handle is stored in the pocket and a deployed position in which the handle extends externally of the pocket where the handle is adapted to be grasped to facilitate emptying the packageable product from the package, said package having a corner where said one wall joins another wall, said pocket having an openable part juxtaposed to said corner to enable withdrawal of said strip from said pocket through said openable part, said pocket extending partially along said other wall.

11. A package including a plurality of walls enclosing a package interior for receiving a packageable product, at least one of said walls having a pocket closed off from said package interior, a handle of flexible material, said handle including a strip, a connection connecting the handle to said one wall, said handle having a stored position in which the handle is stored in the pocket and a deployed position in which the handle extends externally of the pocket where the handle is adapted to be grasped to facilitate emptying the packageable product from the package, said package having a corner where said one wall joins another wall, said handle including a strip, said pocket having an openable part juxtaposed to said corner to enable withdrawal of said strip from said pocket through said openable part, said strip extending partially along said other wall when said handle is in said stored position.

12. A package including a plurality of walls enclosing a package interior for receiving a packageable product, at least one of said walls having a pocket closed off from said package interior, said pocket having one pocket part partially formed by a first section of said at least one wall and another pocket part partially formed by a second section of another one of said walls substantially perpendicular to said at least one wall, a handle of flexible material, a connection connecting the handle to said at least one wall, said connection connecting said handle to said first section of said at least one wall and to said second section of said other wall, said handle having a stored position in which the handle is stored in the pocket and a deployed position in which the handle extends externally of the pocket where the handle is adapted to be grasped to facilitate emptying the packageable product from the package.

13. A package according to claim 1 further including an openable part in one of said package walls which has one disposition which closes off the interior of the package and another disposition which opens up the interior of the package for discharging the pourable material.

14. A package according to claim 1 including a filling device in one of said walls for filling the package.

15. A package according to claim 1 where said handle is a first handle, and a second handle on one of said walls to facilitate transporting the package by hand.

16. A package including end walls and side walls enclosing a package interior for receiving a pourable material, one of said walls having an outer part disposed in superimposed relationship with an inner part and forming a pocket between said outer and inner parts, said inner part closing off the pocket from the package interior, a handle of flexible material, a connection connecting the handle to said one wall, said handle having a stored position in which the handle is stored in said pocket and a deployed position in which said handle extends externally of said pocket where the handle is adapted to be grasped to facilitate emptying the pourable material from the package, said outer part having a line of weakness adapted to be severed to facilitate access to said pocket for effecting removal of said handle from said pocket to thereby change the handle from its stored position to its deployed position.

17. A package according to claim 16 wherein said one wall includes an inner wall layer and an outer covering sheet, said outer part of said one wall being a part of said outer covering sheet, said inner part of said one wall being a part of said inner wall layer.

18. A package according to claim 17 wherein said handle includes a handle strip which is folded when said handle strip is in said stored position, said handle strip having a section which includes a generally Z-shaped fold with upper and lower fold parts being joined to an intermediate fold part by respective fold lines and adhesive adhering said upper fold part to said outer covering layer, said lower fold part being disposed in non-attached superimposed relationship with said inner wall layer when said handle strip is in said stored position.

19. A package according to claim 18 wherein said upper fold part is disposed in non-attached superimposed relationship with one side of said intermediate fold part when said handle strip is in said stored position, said lower fold part being disposed in non-attached superimposed relationship with the other side of the intermediate fold part when the handle strip is in said stored position.

20. A package according to claim 18 wherein said handle has an extending portion extending from said lower fold part, and adhesive adhering said extending portion to said inner wall layer and said outer covering sheet.

21. A package according to claim 16 further including an openable part in one of said package walls which has one disposition which closes off the interior of the package and another disposition which opens up the interior of the package for discharging the pourable material.

22. A package according to claim 21 wherein said openable part includes a flap which is moveable relative to the package along a fold line to said other disposition which opens up the interior of the package for discharging the pourable material.

23. A package according to claim 16 wherein said one wall has a first section and a second section, said handle when in said stored position in said pocket extending at least partially along said first section of said one wall, and further including a filling device in said second section of said one wall for filling the package.

24. A package according to claim 16 where said handle is a first handle, said package having a first end wall and a second end wall, said first handle extending at least partially along said first end wall when said first handle is disposed in said stored position in said pocket, and a second handle on said second end wall to facilitate transporting the package by hand.

25. A package according to claim 21 wherein said openable part includes a flap which is moveable relative to the package along a fold line to said other disposition which opens up the interior of the package for discharging the pourable material.

* * * * *